US008444064B2

(12) United States Patent
Bulling et al.

(10) Patent No.: US 8,444,064 B2
(45) Date of Patent: May 21, 2013

(54) ROTARY SPRAYER

(75) Inventors: Michael Bulling, Stuttgart (DE); Peter Eppacher, Leinfelden-Echterdingen (DE); Reiner Goetz, Stuttgart (DE)

(73) Assignee: Weitmann & Konrad GmbH & Co. KG, Leinfelden-Echterdingen (DE)

( * ) Notice: Subject to any disclaimer, the term of this patent is extended or adjusted under 35 U.S.C. 154(b) by 533 days.

(21) Appl. No.: 12/379,498

(22) Filed: Feb. 24, 2009

(65) Prior Publication Data

US 2009/0212128 A1 Aug. 27, 2009

(30) Foreign Application Priority Data

Feb. 27, 2008 (DE) ..... 10 2008 011 511
Dec. 10, 2008 (DE) ..... 20 2008 016 325 U

(51) Int. Cl.
*F23D 11/04* (2006.01)

(52) U.S. Cl.
USPC ..... 239/222.11; 239/223; 239/225.1; 239/523

(58) Field of Classification Search
USPC ..... 239/214, 222.11, 223, 224, 293, 239/301, 380, 382, 383, 505, 522–524, 679, 239/681, 687, 688, 700–703, 225.1
See application file for complete search history.

(56) References Cited

U.S. PATENT DOCUMENTS 1,488,356 A * 3/1924 Linke ..... 239/219
3,250,473 A * 5/1966 Hermann ..... 239/7
3,342,415 A * 9/1967 Point ..... 239/694
3,478,962 A * 11/1969 Hermann ..... 239/694
3,749,313 A * 7/1973 Weitmann ..... 239/127
4,006,858 A * 2/1977 Farmery ..... 239/7
7,032,893 B2 * 4/2006 Sotoyama et al. ..... 261/89
7,150,414 B2 * 12/2006 Goldin ..... 239/223

FOREIGN PATENT DOCUMENTS

| | | |
|---|---|---|
| DE | 1 973 997 | 8/1967 |
| DE | 1 400 722 | 7/1969 |
| DE | 2 058 667 | 5/1972 |
| DE | 238 548 | 8/1986 |
| DE | 42 27 136 | 2/1994 |
| DE | 100 53 305 | 5/2002 |
| GB | 2 271 068 | 4/1994 |

OTHER PUBLICATIONS

Wozniak, Guenter, "Zerstaeubungstechnik", Berlin. Springer-Verlag, 2003, ISBN: 3-540-41170-4 see in particular text p. 82.
Richter, Thomas, "Zerstaeuben von Fluessigkeiten", Expert-Verlag, 2004, 71272 Renningen. ISBN 3-8169-2309-7.

* cited by examiner (Continued)

*Primary Examiner* — Jason Boeckmann
(74) *Attorney, Agent, or Firm* — Paul Vincent

(57) ABSTRACT

A rotary sprayer (10) for fluids (14), has a rotating disc (22), a drive (58) for the disc (22), and a supply device (28) for the application of fluid (14) onto the disc (22). The disc (22) has a distribution plane (30) for the fluid (14), and at least one opening (34) is provided in the distribution plane (30), via which a secondary flow (50) of the fluid (14) is separated from the main flow (48) to another plane (46). The disc (22) has a first spray edge (44) for spraying the working flow (52) of the fluid (14) and a second spray edge (54) for spraying the secondary flow (50) of the fluid (14). Since the main flow is divided into a secondary flow and a working flow, the effective amount of fluid that is used to moisten the workpiece can be reduced without having to therefore reduce the amount of fluid that is supplied e.g. via the pipe conduit. The formation of drops is thereby reliably prevented and a pipe conduit is used that has a cross-section of adequate size to prevent clogging.

5 Claims, 3 Drawing Sheets

ROTARY SPRAYER

This application claims Paris Convention priority of DE 10 2008 011 511.8 filed Feb. 27, 2008 and DE 20 2008 016 325.0 filed Dec. 10, 2008 the complete disclosure of which is hereby incorporated by reference.

BACKGROUND OF THE INVENTION

The invention concerns a rotary sprayer for fluids. There are many different conventional rotary sprayers for fluids. For example, the publication "Zerstäubungstechnik" (spray technology), ISBN 3-540-41170-4, page 82, discloses a rotary sprayer, in which fluid flow is introduced into a ribbed rotating disc that comprises flow channels, such that the fluid is centrifuged to the outside with a radial component due to the rotary motion of the disc. The publication "Zerstäuben von Flüssigkeiten" (spraying of fluids), ISBN 3-8169-2309-7, page 74, discloses different rotating disc designs which are formed e.g. as smooth discs, cups that are open towards the bottom, perforated or ribbed discs or porous hollow cylinders. In any case, the fluid is always added via one or more pipe conduits. DE 42 27 136 A1 moreover discloses a device for moistening a moving material web, wherein the fluid is discharged by means of a spraying device that comprises a number of rotating discs. DE 100 53 305 A1 discloses a fluid application device, wherein the fluid is centrally introduced into a rotating disc by means of a pipe conduit, the rotating disc having a downwardly projecting drive axis.

The amount of sprayed fluid is adjusted in that varying amounts of fluid are introduced into the rotating disc by means of the pipe conduit. This is disadvantageous in that, when the amount of fluid per time unit drops below a certain level, the pipe conduit no longer discharges the fluid in a continuous fashion but in the form of drops. When the fluid is added in the form of drops, the fluid discharge is highly discontinuous with the result that the workpieces, e.g. paper or textile webs, are wetted in a highly irregular fashion.

One further problem is the fact that pipe conduits having a very small inner diameter tend to clog due to impurities that are carried along in the fluid, or fluid additives such that the fluid supply is interrupted. For this reason, the pipe conduits must have a certain size to ensure that the finest impurities are flushed out by the fluid.

It is therefore the underlying purpose of the invention to provide a rotary sprayer that also discharges very small amounts of fluid.

SUMMARY OF THE INVENTION

In accordance with the invention, this object is achieved with a rotary sprayer for fluids that comprises a rotating disc, a drive for the disc, and a supply device for applying the fluid to the disc, wherein the disc has a distribution plane for the fluid and the distribution plane has at least one opening via which a secondary flow of the fluid is separated from the main flow to a different plane, wherein the disc has a first spray edge for spraying the working fluid flow, and a second spray edge for spraying the secondary fluid flow.

The inventive rotary sprayer also has a rotating disc, to which the fluid to be sprayed is introduced or applied e.g. by means of a pipe conduit. However, this rotating disc no longer discharges the entire amount of applied fluid via the spray edge, but the applied fluid, i.e. the main flow, is divided into a secondary flow and a working flow. This distribution is realized via one or more openings that are provided in the distribution plane. In this fashion, the secondary flow reaches a different, i.e. a second spray edge, and is discharged at that location. The remaining working flow that is used to moisten the workpiece is sprayed via the first spray edge. Since the main flow is divided into a secondary flow and a working flow, the effective amount of fluid that is used to moisten the workpiece can be reduced without having to therefore reduce the amount of fluid that is supplied e.g. via the pipe conduit. The formation of drops is thereby reliably prevented and a pipe conduit is used that has a cross-section of adequate size to prevent clogging and also prevent the entire amount of supplied fluid, i.e. the entire main flow, from being sprayed onto the workpiece. The secondary flow is separated from the main stream via the opening(s), and is then discharged via the second spray edge, wherein this secondary flow can be extracted via suitable apertures or discharged via other devices, and deflected to a tank.

In one preferred further development, the first spray edge is disposed above the second spray edge and/or the two spray edges have the same radius. The spray disc substantially has the shape of a flat diabolo or the shape of a flat hourglass. Since the two spray edges have different heights, the secondary flow sprayed from the lower spray edge can be extracted in a relatively simple fashion by means of an aperture and e.g. be discharged to a tank. Since the two spray edges have the same radial separation from the axis of rotation, the spray conditions and spray ratios of the working flow sprayed above and the secondary flow sprayed below are substantially the same. The opening(s) may moreover be disposed at a relatively large radial separation.

Several openings are advantageously provided, which are moreover uniformly distributed over the periphery between the axis of rotation and the spray edge. The openings substantially form a perforated circle through which the secondary flow flows. The volume of the secondary flow is adjusted by the arrangement, the shape, the size and the position of the openings.

In a further development, there is a height offset in the distribution plane in the area of the opening from the radially inner to the radially outer area. The radially inner area is thereby advantageously lower than the radially outer area. The working flow must therefore move from the radially inner lower area to the radially outer higher area. Since this transition area comprising the openings represents a relatively large obstacle for the fluid, it is sufficient to provide openings with a relatively small opening cross-section and/or a relatively small number of openings to generate a large secondary flow and therefore a small working flow.

In accordance with one embodiment of the invention, webs are provided between the openings, wherein the web surfaces facing the main flow are formed like ramps. The webs may be flat and/or concavely or convexly curved. In this fashion, the amount of the secondary flow or the amount of the working flow can be additionally controlled. The width of the webs may also increase and/or decrease from the radially inner to the radially outer area.

In one advantageous inventive embodiment, the cross-section of the opening can be adjusted. It is thereby possible to precisely adjust the amount of the secondary flow or the amount of the working flow to be applied to the workpiece. The setting of the cross-section of the opening can e.g. be changed by displacing apertures, by inserts or the like.

In one embodiment, the distribution plane and the other plane are substantially mirror symmetrical with respect to each other and/or to a horizontal section. The other plane that is disposed below the distribution plane extends, in particular, in an orthogonal direction relative to the axis of rotation and may e.g. have no offset. The effective area of this plane is located radially outside of the openings, i.e. between the openings and the second spray edge.

The drive is positioned below the disc so that the fluid can be centrally applied to the disc, which is also advantageous in that the drive is not wetted by the fluid. Cleaning is moreover considerably facilitated, since the distribution plane is freely accessible.

In one embodiment, the drive is dimensioned such that the second spray edge is positioned radially outside of the drive. The fluid is thereby sprayed from the disc only after it has reached a peripheral area that is larger than the drive.

Further advantages, features and details of the invention can be extracted from the dependent claims and the following description which describes in detail two particularly preferred embodiments with reference to the drawing. The features shown in the drawing and mentioned in the description and in the claims may thereby be essential to the invention individually or in arbitrary combination.

DESCRIPTION OF THE PREFERRED EMBODIMENT

Figure 1:
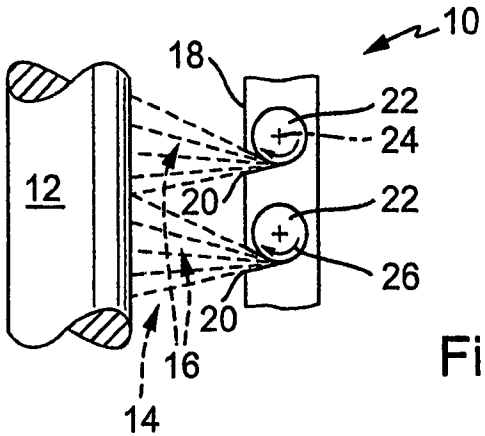
FIG. 1 schematically shows a simplified view onto a rotary sprayer with two rotating discs.

FIG. 1 shows a rotary sprayer, designated in total with 10, which sprays fluid 14 onto a workpiece 12. The part of the fluid shown in FIG. 1 forms the effective working flow 16 that moistens the workpiece 12, e.g. a roller or a paper or textile web. This working flow 16 leaves a housing 18 (not shown in detail) via apertures 20, wherein several rotating discs 22 are disposed in the housing 18, which rotate about an axis of rotation 24 e.g. in the direction of the arrow 26.

Figure 2:
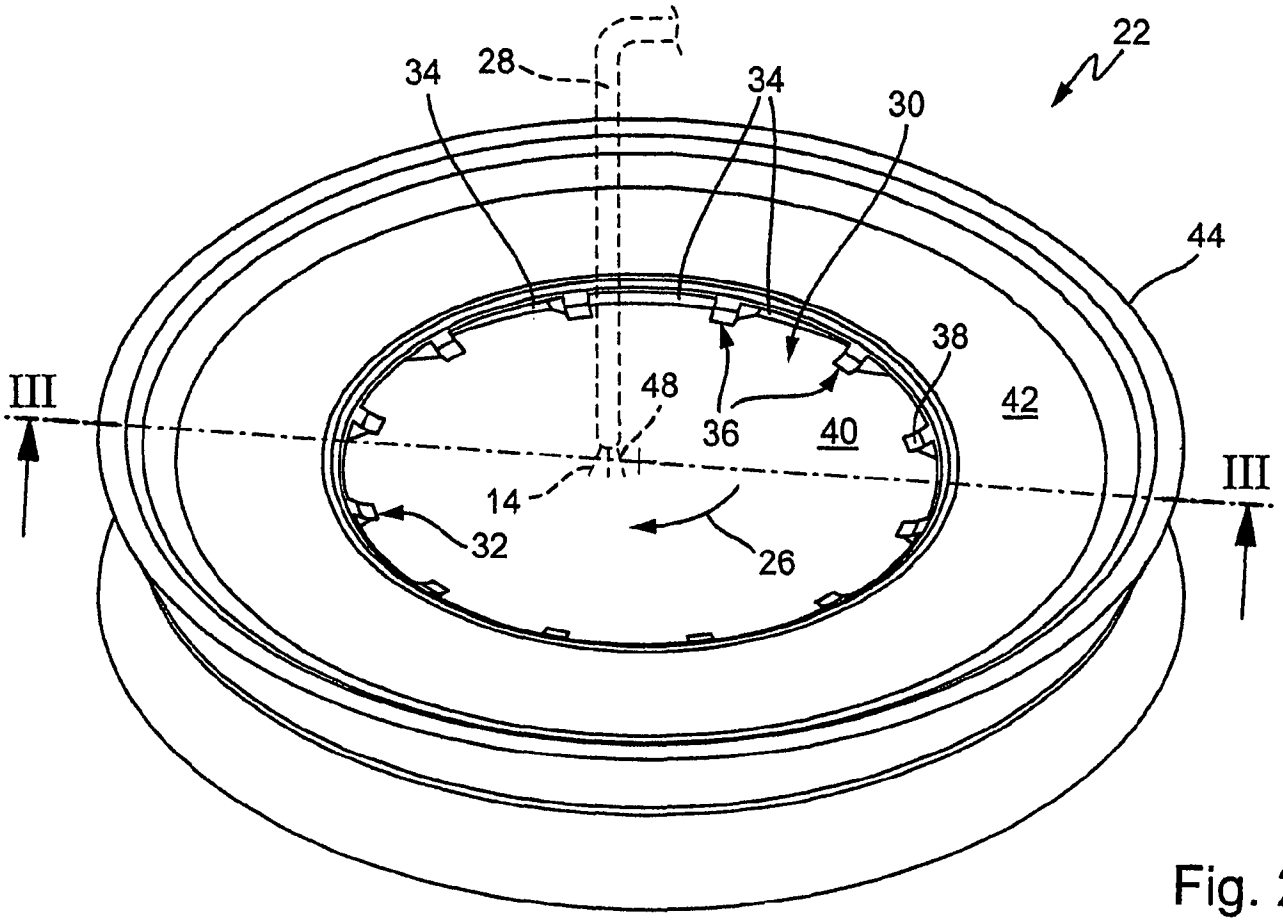
FIG. 2 shows a perspective view of a first embodiment of the rotating disc.

FIG. 2 shows a perspective view of a first embodiment of the rotating disc 22 onto which the fluid 14 is applied by means of a pipe conduit 28 that is schematically indicated. The fluid 14 flows onto a distribution plane, designated in total with 30, flows thereon in a radial outward direction and reaches an area 32 having a plurality of openings 34. Webs 36 having web surfaces 38 that extend like ramps are provided between the openings 34. These web surfaces 38 extend between a radially inner area 40 and a radially outer area 42 of the distribution plane 30. This distribution plane 30 and thereby also the radially outer area 42 terminate at their radially outer ends in a first spray edge 44.

Another, second plane 46 is disposed opposite to the distribution plane 30 (shown in FIG. 3), which forms the lower side of the rotating disc 22. When the fluid 14 moves from the radially inner area 40 to the area 32 with openings 34, the main flow 48 is divided into a secondary flow 50 that passes the openings 34 and a working flow 52 that bypasses the openings 34 and reaches the radially outer area 42. The working flow 52 is sprayed via the first spray edge 44 (FIG. 3) and the secondary flow 50 is sprayed via a second spray edge 54.

Figure 3:
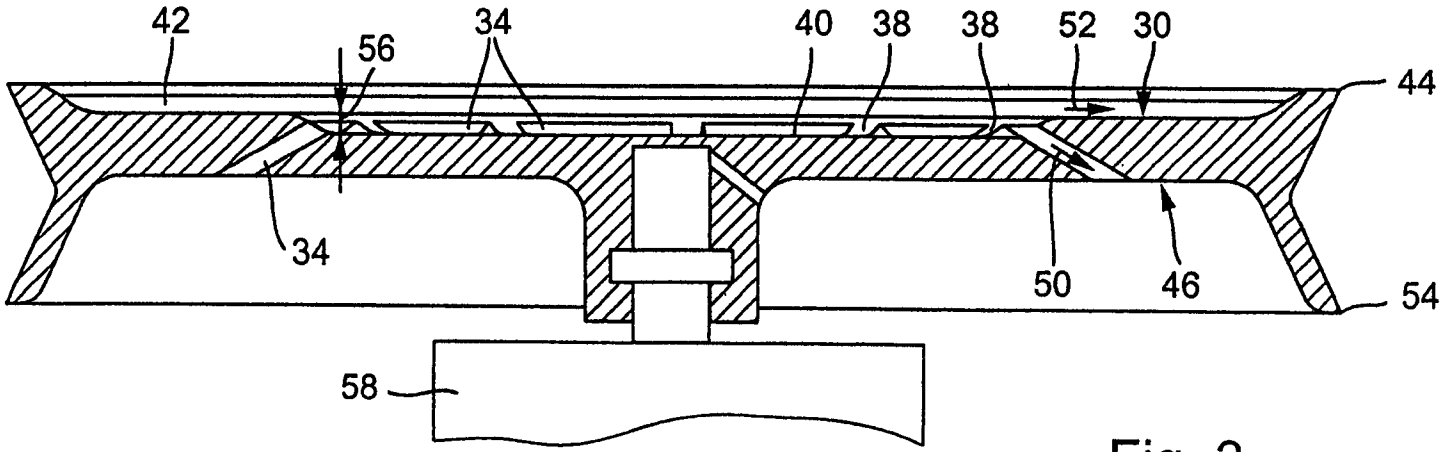
FIG. 3 shows a section III-III through the rotating disc in accordance with FIG. 2.

FIGS. 2 and 3 also show that the radially inner area 40 is lower than the radially outer area 42 and therefore has a height offset 56. FIG. 3 also shows that a drive 58 is provided below the rotating disc 22, which is positioned radially within the openings 34 and also radially within the second spray edge 54, such that the drive 58 is not wetted by the fluid 14.

Figure 4:
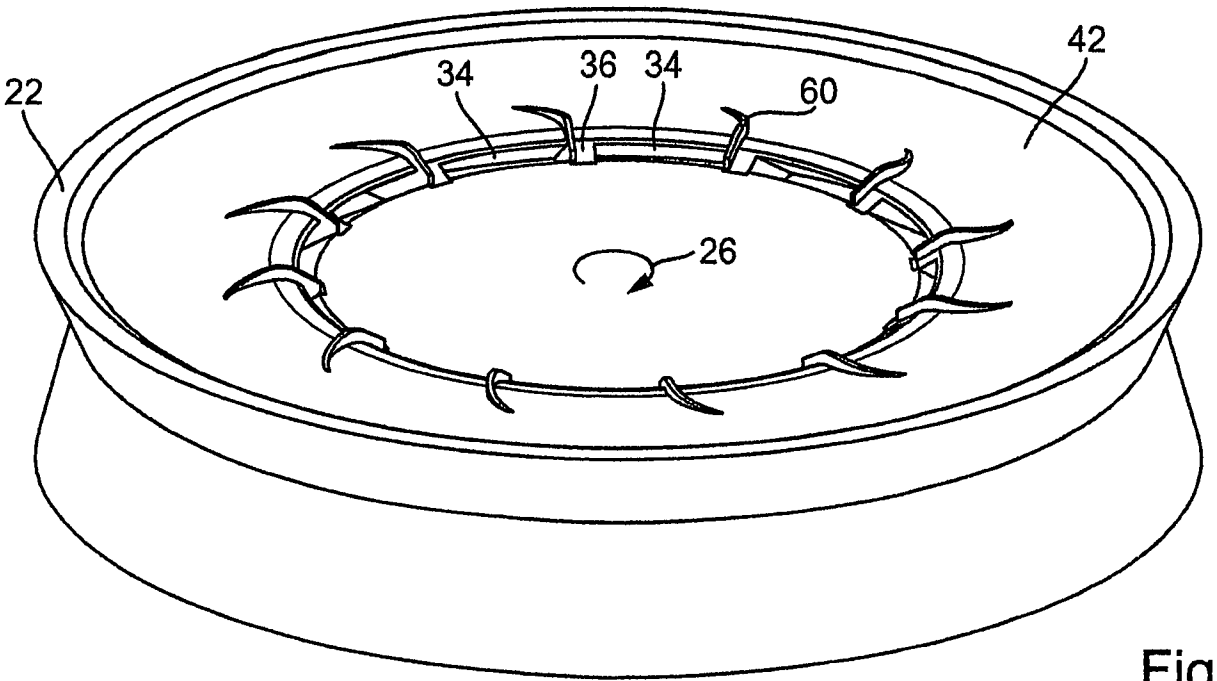
FIG. 4 shows a second embodiment of the rotating disc.

In the embodiment shown in FIG. 4, the web 36 and, in particular its web surface, is flanked by a web wall 60 which is located behind the web 36, as viewed in the direction of rotation (arrow 26). The web wall 60 forms a boundary that prevents the fluid that flows on the web surface in a radial outward direction from flowing laterally into the openings 34. Due to the inertia of the fluid, the fluid flows along the web 36 and the web wall 60 in a radial outward direction to the outer area 42. The height of the web wall 60 is constant or increases in the radial direction. The web wall 60 moreover extends into the outer area 42 and continues to guide the fluid. The height of the web wall 60 is thereby reduced and the web wall 60 is also curved in an opposite direction to the direction of rotation (arrow 26). The working flow 52 that reaches the outer area 42 is less accelerated due to the curve of the web wall 60, and is distributed and fanned out via the surface of the outer area 42.

The ratio between the working flow 52 and secondary flow 50 is determined by the size of the cross-section of the openings 34, the shape, position and shape of the web surfaces 38 and their surface structure or, if present, by the height and shape of the web wall 60.

We claim:

1. A rotary sprayer for fluids, the sprayer comprising:

a drive;

a supply device for transport and application of a main fluid now;

a rotating disc, said rotating disc cooperating with and driven by said drive, said disc structured and disposed to receive the main fluid flow from said supply device, said disc having an upward surface defining a radially inner area and a radially outer area which is offset in an upward direction from said radially inner area, wherein said disc has a plurality of annular openings disposed between said radially inner and said radially outer area, said annular openings said radially inner and outer areas, wherein a secondary flow is separated from the main fluid flow for passage through said annular openings, thereby leaving a residual working flow on said upward surface, said disc also having a first spray edge communicating with said radially outer area for spraying the residual working flow;

webs having web surfaces facing the residual fluid flow and shaped like radially directed ramps, said webs forming bridges across said annular openings which connect said radially inner area to said radially outer area to direct the residual fluid flow in a radial and upward direction from said radially inner to said radially outer area; and web walls, each web wall bordering one web and located behind said respective web as viewed in a direction of rotation of said rotating disc, said web walls extending vertically and protruding upwardly and in an axial direction beyond said web surfaces to radially direct the residual fluid flow on said web surfaces towards said radially outer area.

2. The rotary sprayer of claim 1, wherein said annular openings are uniformly distributed in a peripheral direction between an axis of rotation and said first spray edge.

3. The rotary sprayer of claim 1, wherein a height of said web walls is constant or increases up to said radially outer area.

4. The rotary sprayer of claim 1, wherein heights of said web walls decrease in said radially outer area.

5. The rotary sprayer of claim 1, wherein said web walls are curved in a direction opposite to a direction of rotation of the disc in said radially outer area.

* * * * *